United States Patent [19]

Rytlewski

[11] Patent Number: 4,961,365

[45] Date of Patent: Oct. 9, 1990

[54] PERFORATING GUN WITH ROTATING CHARGES INCLUDING A MECHANICAL LINK RETAINING MECHANISM

[75] Inventor: Gary L. Rytlewski, League City, Tex.

[73] Assignee: Schlumberger Technology Corporation, Houston, Tex.

[21] Appl. No.: 225,330

[22] Filed: Jul. 28, 1988

[51] Int. Cl.[5] ..... E21B 43/118

[52] U.S. Cl. ..... 89/1.15; 175/4.53

[58] Field of Search ..... 175/4.53, 4.6; 102/310; 89/1.15

*Primary Examiner*—David H. Brown

*Attorney, Agent, or Firm*—Henry N. Garrana; John H. Bouchard

[57] ABSTRACT

A perforating gun contains charges which are rotatable between a stored position and a deployed position, the charges being connected to an enclosed carrier tube via a mechanical link retaining apparatus which is capable of bending but is incapable of stretching by any substantial distance. A primacord is held by said retaining apparatus firmly onto a top of each charge thereby preventing relative movement between the primacord and the charge when the charge is deploying between its stored position and its deployed position. A set of pullrods connect to each pivot of each charge. Thus, when an upward force is placed on the pullrods, an accompanying force is placed on the pivots of each charge. Since the retaining apparatus connects to the top of each charge and to the carrier, and since the retaining apparatus is incapable of stretching by any substantial distance, the accompanying force on the charge pivots creates a torque which rotates the charges between the stored position and the deployed position.

10 Claims, 3 Drawing Sheets

20
22
40
24
28
26
18
26a
0,6"
1,2"

PERFORATING GUN WITH ROTATING CHARGES INCLUDING A MECHANICAL LINK RETAINING MECHANISM

BACKGROUND OF THE INVENTION

The subject matter of the present invention relates to perforating guns used in oil well boreholes, and, more particularly, to a perforating gun having rotating charges for positioning charges prior to detonating the charges.

Rotating charge perforating guns of the prior art possessed several problems which created a need for the subject invention. For example, springs were required for each charge thereby limiting the size of a perforating charge which could be packaged within a limited gun diameter. Since penetration into a formation is of prime importance and since penetration is a function of the size of a charge, the performance of prior art designs is inferior to the performance of the subject invention. Prior art rotating charge perforating guns deployed charges in series, creating a reliability problem from the standpoint of gun deployment. For example, the prior art rotating charge guns (Swing Guns) deployed the charges in series with an initial torque of 13.5 in-lb which decreased to less than 5 in-lb in the fully deployed position. If one charge failed to deploy, all remaining undeployed charges could not deploy nor could the gun be fired. The Swing Guns were 10 feet long with 41 charges. If the reliability of deployment was 99.5%, per charge, the gun had a 81.4% chance of fully deploying and firing. If the reliability of deployment was 95% per charge, the gun only had a 12.2% chance of ever firing. The swing gun design of the prior art was very sensitive and did experience deployment reliability problems. In addition, relative motion between the charge primacord and the charge itself, during deployment of prior art guns, sometimes caused charge misfires. Since pivots were exposed to the external surface of the gun carrier, rubbing of the gun carrier against the oil well tubing damaged the pivots and the other small mechanical parts which compromised the deployment of charges of the prior art. Furthermore, the swing gun of the prior art contained 82 pivots screwed into the charge cases, with pivot heads flush with the carrier. These exposed pivots caused the swing gun to stick inside the tubing. This problem was especially evident when the charges were deployed and not fired. In retrieving an unfired swing gun, the charges were spring loaded into the deployed position and rubbed against the tubing. If any one pivot worked loose, the gun became stuck inside the tubing. Furthermore, rotating charge perforating guns of the prior art have an inherent conflict in design. Prior art perforating guns only rotated or only translated the charges during deployment, not both. It is highly desirable that the charges both rotate and translate during deployment, because the perforating charge needs to be as large as possible to maximize the perforating performance while the mechanical mechanism needs to be strong and rugged enough to reliably deploy the charges in a hostile environment deep in an oil or gas well. However, strong mechanical linkages take space and reduce the size of the perforating charge in the gun. Therefore, a compromise was always made on prior art perforating guns between charge size and deployment strength, and, indirectly, between charge size and deployment reliability.

SUMMARY OF THE INVENTION

Accordingly, it is a primary object of the present invention to provide a rotating charge perforating gun design which eliminates all the disadvantages and problems associated with the prior art rotating charge perforating gun.

It is a further object of the present invention to provide a rotating charge perforating gun design which provides both translation and rotation during charge deployment.

It is a further object of the present invention to design a 4-bar sliding linkage mechanism for a rotating charge perforating gun which comprises an encapsulated explosive charge with pivots, a hollow exterior carrier tube, sliding pullrods and a mechanical link between the carrier and charge which can bend but resists changes in length.

In accordance with these and other objects of the present invention, the mechanical link is capable of bending, but is incapable of stretching. Since it can bend, the mechanical link permits the charge to translate upward, during deployment, by an arbitrary amount (i.e., 0.6 inches in the preferred embodiment) while also permitting the charge to rotate from its stored position to its deployed position.

The exterior carrier is a thin tube-like member with features for guiding the pullrods. The pullrods are thin long members with holes disposed therethrough that accept a set of pivots mounted on the charges. Axial forces are exerted on the pullrods for the pulling or pushing against the pivots. Alternatively, the pivots may be mounted on the pullrods for mating with holes disposed through the charge. Because of the thin nature of the carrier and pullrods, the charge is as large as possible to optimise the performance in terms of perforation. The mechanical link between charge and carrier has several functions. The primary function is to restrain the primacord end of the charge from traveling the same distance the pivots travel when the pullrods are displaced upward during deployment. The mechanical link, as it connects to the charge, provides a means of capturing the primacord, maintaining zero relative motion between charge and primacord in the critical area of charge initiation thereby reducing misfires. A third function is to provide a mechanical fuse for redeployment if the gun is deployed and not fired. A deployed gun is much larger than the oil well tubing which it passed through prior to deployment. Therefore, there must be a means of retrieving the deployed gun if the gun can not be fired. The mechanical link therefore is designed to break when the gun is being pulled into the tubing, releasing the torque on the charge and allowing the charge to rotate back into a stored position only slightly higher in the carrier than was previously the case. One embodiment of the retaining mechanism includes a wireform The retaining mechanism (such as, the wireform) is capable of bending, but is not capable of stretching. When a force (upward or downward) is placed on the pullrods, an accompanying force is placed on the pivot which, in turn, places an accompanying force (upward or downward) on the charge. However, the retaining mechanism (e.g., the wireform), being connected to the gun tubing wall, prevents the charge from moving upward or downward. Therefore, a torque is created, which torque rotates the charge either clockwise or counterclockwise. Since the retaining mechanism is in-capable of stretching, a maximum torque is created, which is needed for rotating the charges in the perforating gun.

Further scope of applicability of the present invention will become apparent from the detailed description presented hereinafter. It should be understood, however, that the detailed description and the specific examples, while representing a preferred embodiment of the invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 1:
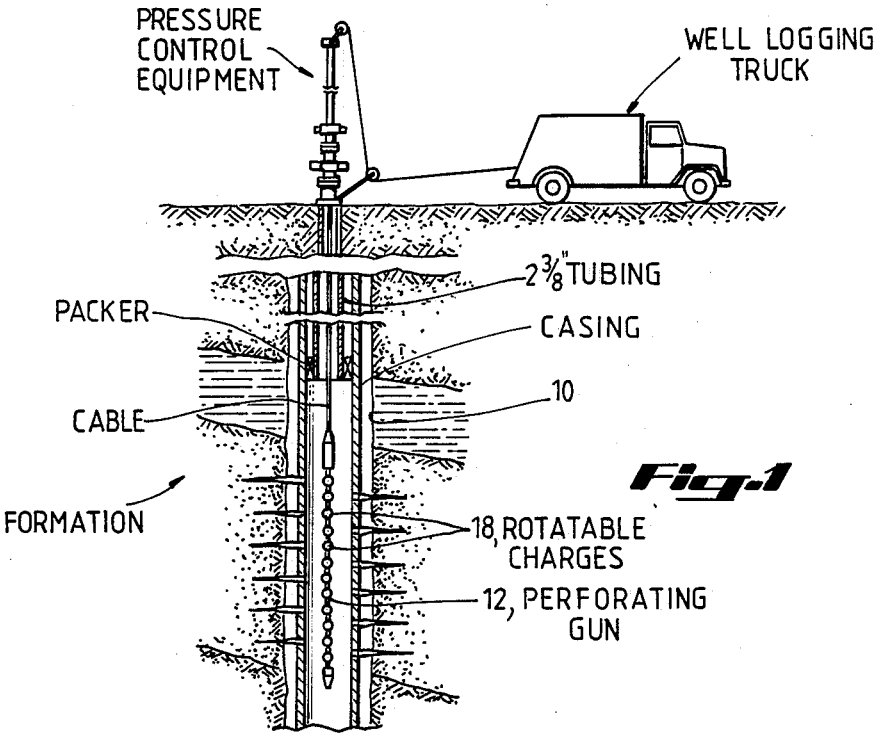
FIG. 1 illustrates a borehole of an oil well wherein the perforating gun of the present invention is disposed, the gun containing the rotatable charges and the associated mechanical link retaining mechanism of the present invention.

Referring to FIG. 1, a borehole 10 of an oil well is illustrated, the perforating pivot gun 12 of the present invention being disposed in the borehole The perforating gun 12 is actually a pivot gun 12, since the charges in the gun pivot about an axis from a stored to a deployed position. When deployed, the charges of the pivot gun 12 detonate and penetrate the formation. Deployment of the pivot gun 12 involves rotation of the pivot gun charges from a first stored position to a second deployed position, the first position being defined as one where the axis of a charge is parallel to the axis of the gun 12, the second position being defined as one where the axis of the charge is perpendicular to the axis of the gun 12.

Referring to FIGS. 2*a* through 2*c*, and FIG. 3, side and top views, respectively, of the perforating/pivot gun 12 of the present invention are illustrated.

Figure 3:
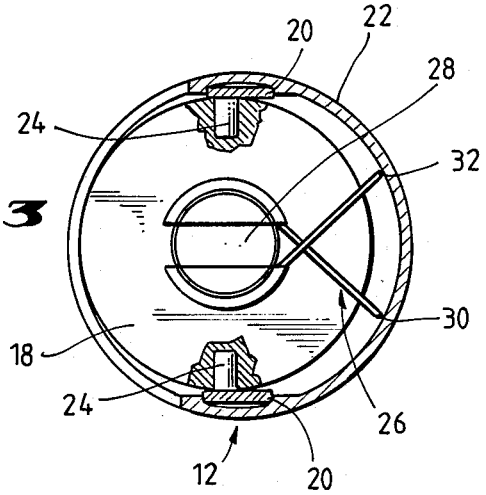
FIG. 3 illustrates a top view of a charge when disposed in the perforating gun of the present invention.

In FIG. 3, a top view of pivot gun 12 is illustrated. Pivot gun 12 includes a carrier 22 in which a charge 18 is disposed. Charge 18 includes two pivots 24, one on each end of the charge. The pivots 24 are, in turn, each connected to a pullrod 20. Each pullrod 20 is connected, at its other end, to a deployment head (not shown). A mechanical link retaining mechanism connects the top of each charge 18 to the carrier 22. In the FIG. 3 embodiment, the retaining mechanism comprises a mechanical link 26, or wireform 26. The wireform 26 is a piece of wire which cannot stretch, but it can bend. It is very important that, for efficient operation of the mechanical link retaining mechanism of the present invention, the retaining mechanism (in this embodiment, the wireform 26) be capable of bending, but be incapable of stretching. The wireform 26 is wrapped around the top 28 of charge 18, each end of the wireform 26 being connected to the carrier 22; one end of wireform 26 being connected to the carrier 22 at end 30, the other end of wireform 26 being connected to the carrier 22 at end 32. A primacord is disposed on the top 28 of charge 18. This cord is used for detonating the charge. Since the wireform 26 is wrapped around the top 28 of charge 18, it holds the primacord firmly onto the top 28 of charge 18. Therefore, when the charge 18 rotates or pivots from its first stored position to its second deployed position, the primacord will be prevented and restrained from moving relative to the charge 18. As a result, the charge 18 will not misfire.

Figure 2C:
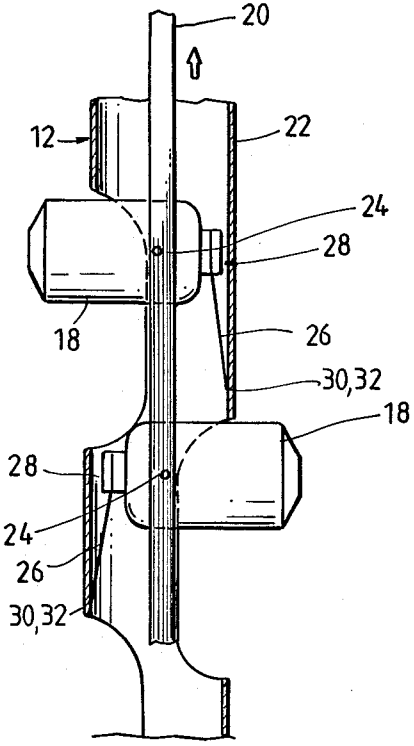
FIGS. 2*a* through 2*c* illustrates side views of the perforating gun of the present invention, and in particular, the rotatable charges and the mechanical link retaining mechanism of the present invention.
Figure 2B:
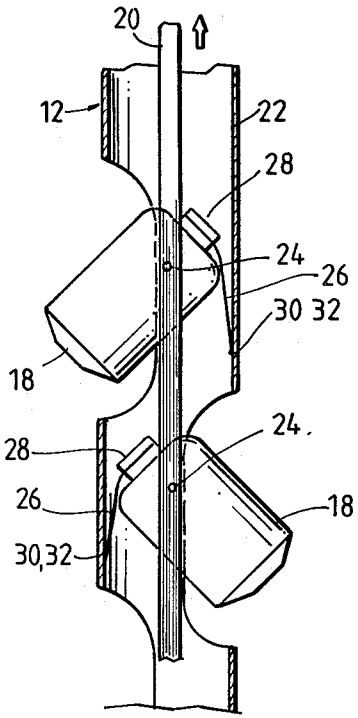
Figure 2A:
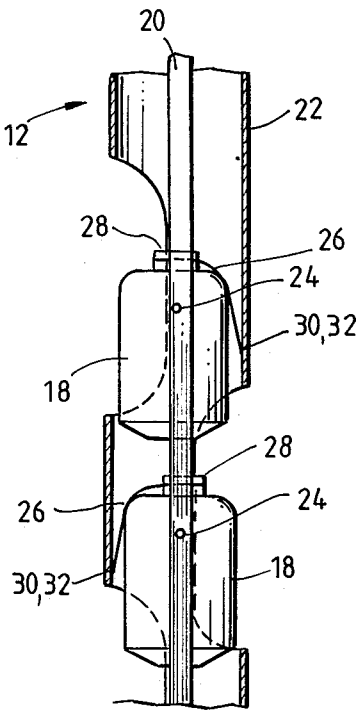

In FIGS. 2*a* through 2*c*, side views of pivot gun 12 are illustrated. FIG. 2*a* shows a plurality of charges 18 disposed in the gun 12 in a stored position FIG. 2*b* shows the charges 18 disposed in the gun 12 in a 50% deployed position. FIG. 2*c* shows the charges 18 disposed in the gun 12 in a fully deployed position.

As shown in the stored position of FIG. 2*a*, a mechanical link retaining mechanism, or wireform, 26 is wrapped around the top 28 of each charge 18, each retaining mechanism being connected to the carrier 22 in positions 30 and 32. A pullrod 20 is connected to each pivot 24 of each charge lB and to a deployment head which pulls the pullrods 20 during deployment of the charges 18 and pushes the pullrods during storage of the charges 18. As shown in the deployed positions of FIGS. 2*b*–2*c*, when the deployment head pulls upward on the pullrod 20, the top 28 of each charge 18 moves no more than 0.6 inches, since the wireform 26, which connects top 28 to carrier 22, restrains the top 28 of charge 18 from moving more than the 0.6 inches.

Figures 4A, 4B, 4C:
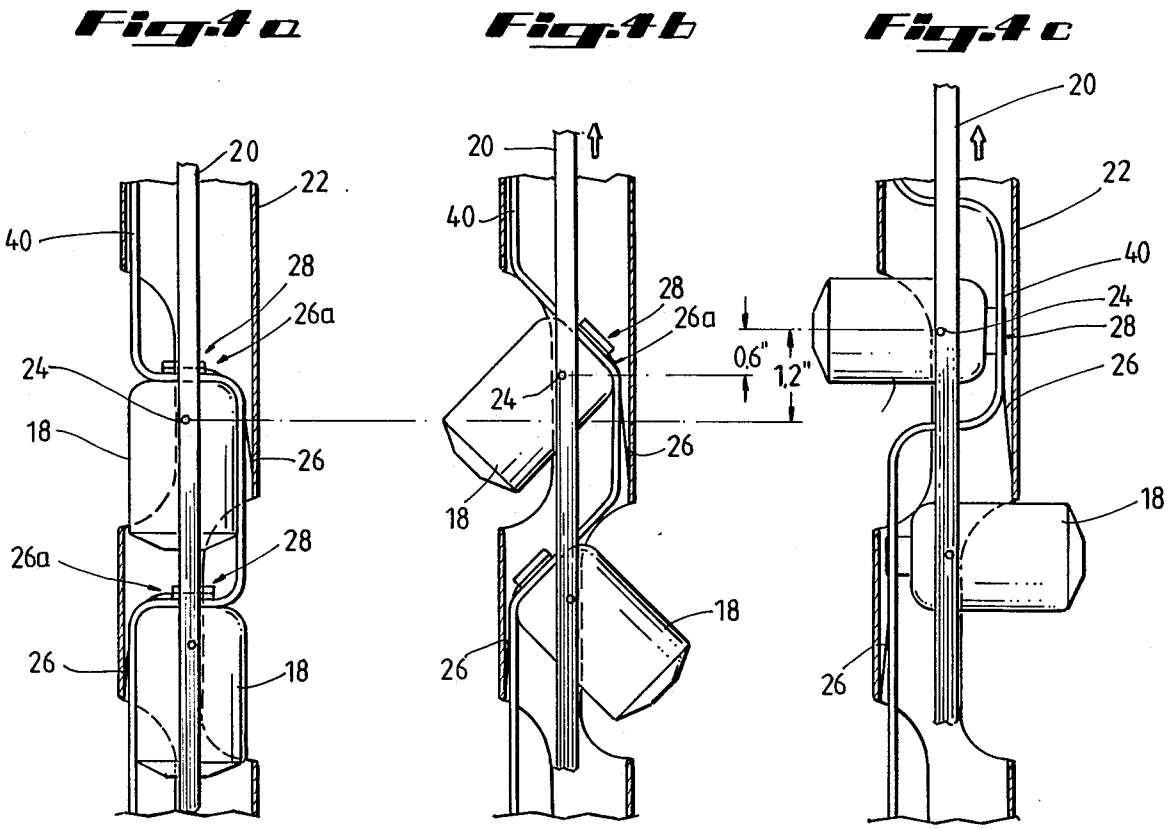
FIGS. 4*a* through 4*c* illustrate side views of the perforating gun of the present invention, showing how the primacord is attached to each charge of the gun.

Referring to FIGS. 4*a* through 4*c*, side views of the perforating gun of FIGS. 2*a*–2*c* are illustrated, showing how a primacord is attached to each charge of the perforating gun.

In FIG. 4*a*, a primacord 40 runs along the length of the perforating gun, being disposed under each mechanical link wireform 26 of each charge 18. The wireform 26 includes one end attached to the carrier 22, another end also attached to the carrier 22, and an intermediate part 26*a* attached to a top 28 of the charge. The intermediate part 26*a* of the wireform 26 holds primacord 40, since primacord 40 is disposed between the top 28 of the charge and the intermediate part 26*a* of the wireform 26. Therefore, when the charge 18 rotates, the intermediate part 26*a* of wireform 26 holds primacord 40 thereby preventing the primacord 40 from moving relative to the charge 18. As a result, misfires of the charge 18 are prevented from occurring. For example, in FIGS. 4*b* and 4*c*, note how primacord 40 is prevented from moving relative to charge 18 when the charge 18 rotates about its pivot 24. In FIG. 4*c*, note the "pullrod travel", how the charges 18 have rotated, and note especially the "translation distance", which represents the distance travelled by the pivot 24 when the charge 18 rotates in response to a pull upward on the pullrods 20. Therefore, the charges 18 both rotate and translate when deployed from a stored position, as shown in FIG. 4*a*, to a deployed position, as shown in FIG. 4*c*.

Figure 5:
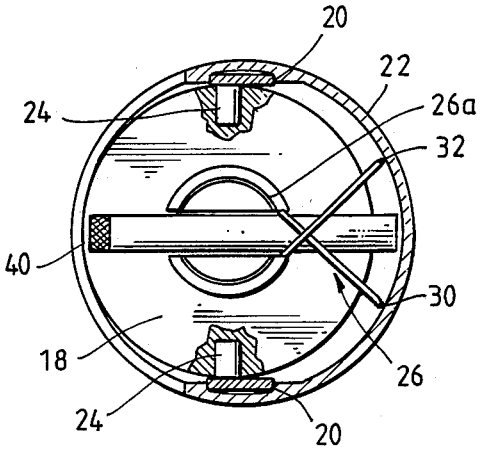
FIG. 5 illustrates a top view of a charge, showing the primacord being held by the wireform mechanical link, as illustrated in FIGS. 4*a*–4*c*.

Referring to FIG. 5, a top view of a charge is illustrated, showing how the primacord is held by the mechanical link 26 onto the top of the charge.

In FIG. 5, a primacord 40 (otherwise termed a detonator cord) is held onto top 28 of charge 18 by intermediate part 26a of the mechanical link 26. The mechanical link 26 is connected on one end 30 to carrier 22 and on the other end 32 to carrier 22.

A functional description of the retaining mechanism (e.g., wireform 26) of the present invention will be set forth in the following paragraph with reference to FIGS. 2a–2c, 3, 4a–4c and 5 of the drawings, with particular reference being made to FIGS. 2a–2c and 4a–4c of the drawings.

The following description will set forth the functional operation of one charge 18 in the pivot gun 12 when the deployment head pulls up and down on the pullrods 20 associated with the one charge. All other charges react the same way as that which is described below with respect to the one charge.

The mechanism of the rotating perforating gun (pivot gun) of the present invention is unique as compared to prior art rotating perforating guns because the charge translates and rotates during deployment. This is a subtle but important distinction over prior art pivot guns which only rotated or only translated during deployment. In kinematic terms, the charge 18 is a coupler in a 4-bar linkage which is indirectly attached to a stationary member (the carrier 22 in the FIG. 2 and 4 pivot gun) via other members: a crank (pullrods 20) and a follower (mechanical link 26). This indirect attachment to the stationary member (carrier 22) allows more design freedom in making the crank (pullrods 20) strong and straight yet very thin and also making the perforating charge as large as possible while still providing means for producing large deployment torques on the charges. The follower (mechanical link 26) is designed to be very thin thereby consuming very little space and only space not affecting the size of the charge. The key to the pivot gun involves the simple shapes, few moving pieces and the large deployment forces/torques which are very important in making the deployment of the charges reliable in a hostile oil well environment. Because the charges are indirectly linked to the carrier, via the wireform mechanical link 26, the pivots 24 are placed in such a manner as to allow the pullrod 20 design to be straight, slim and strong. In addition, because the pivots are not attached to the carrier, the carrier is designed to protect the pivots from damage during descent into the oil well.

Assume that charge 18 is in its first, non-deployed position (FIG. 2a), and that it is desired that the charge 18 be retracted to its second, deployed position (FIG. 2c). The deployment head pulls up on both pullrods 20. In response, pullrods 20 pull up on both pivots 24 of the charge. Since pivots 24 are connected to the charge 18, charge 18 tends to move upward in response to the upward pull of pullrods 20. However, charge 18 is also connected to carrier 22 via the mechanical link retaining mechanism 26 of the present invention. In this embodiment, the wireform 26 (the mechanical link retaining mechanism) is connected to the carrier 22 at positions 30 and 32, and is connected to the top 28 of charge 18. Therefore, when charge 18 tends to move upward in response to the upward pull of pullrods 20, since the wireform retaining mechanism cannot stretch, but can only bend, wireform 26 restrains the top 28 of charge 18 from moving upward, the restraint preventing top 28 from moving upward by more than 0.6 inches while the pivots 24 in the middle of charge 18 move 1.2". Since wireform 26 is wrapped around the top 28 of charge 18 and is connected to the carrier 22, the upward movement of charge 18 creates a rotating torque which tends to rotate the charge 18. As the charge 18 continues to move upward, since the wireform 26 cannot stretch (it can only bend), a pulling on the top 28 of charge 18 by wireform 26 creates the torque which rotates the charge 18 from its first, non-deployed position, to its second, deployed position. Similarly, when the charge 18 is in its second, deployed position, a downward push on pullrod 20 creates a downward pushing force on pivot 24 of charge 18. But, since the wireform 26 is wrapped around the top 28 of charge 18, is connected to the carrier 22, and cannot stretch (it can only bend), the downward force on pivot 24 creates another torque, since wireform 26 prevents charge 18 from moving downward by more than 0.6 inches. Therefore, the charge 18 rotates from its second, deployed position to its first, non-deployed position. In a downhole situation, the presence of oil and mud may prevent the downward pull on pivot 24 from rotating the charges 18. In this situation, the wireform 26 is designed to break when the gun 12 is pulled into the borehole tubing thereby allowing the charges 18 to rotate easily from its deployed position to its stored position.

In FIG. 2a, both charges 18 are stored. Wireform retaining mechanism 26 connects the top 28 of each charge 18 to the carrier 22 at locations 30, 32. In FIG. 2b, the pullrods 20 are pulled upward, which places an accompanying upward force on pivots 24 of both of the charges 18. Wireform retaining mechanism 26 connects the top 28 of each charge to points 30, 32 of the carrier 22. As a result, wireform 26 pulls down on the top 28 of each charge 18 as the charge tends to move upward in response to the pulling force of pullrods 20. Since wireform 26 cannot stretch, but can only bend, charges 18 cannot continue to move upward. Therefore, charges 18 tilt relative to the vertical. In FIG. 2c, since wireform mechanical link retaining mechanism 26 cannot stretch, but can only bend, the continued upward movement of pullrods 20 on pivots 24 of charges 18 cause the charges 18 to continue to tilt, until each charge 18 assumes a horizontal orientation relative to the carrier 22.

In FIGS. 4a–4c and FIG. 5, when the pullrods 20 are pulled upward, the charges 18 rotate as described above. However, primacord 40, being disposed between top 28 of charge 18 and the intermediate part 26a of wireform 26, is held firmly down onto top 28 of charge 18 by the intermediate part 26a of wireform. Therefore, when the charges 18 rotate, the primacord 40 does not move relative to the charge 18. As a result, misfires of charges 18 are prevented.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims:

I CLAIM:

1. A perforating gun for use in oil well boreholes, comprising:

charge means rotatable between a first stored position and a . second deployed position for detonating and perforating a formation, said charge means having pivots;

carrier tube means for enclosing said charge means;

a retaining apparatus connecting a top of said charge means to a wall of said carrier tube means, said retaining apparatus being capable of bending but being incapable of stretching by any substantial distance; and pullrod means connected to the pivots of the charge means for placing a force on said pivots of said charge means in response to an accompanying force placed on said pullrod means, said charge means rotating between said first stored position and said second deployed position and said retaining apparatus bending but not stretching any substantial distance when said pullrod means places said force on said pivots of said charge means.

2. The perforating gun of claim 1, wherein the retaining apparatus comprises a wireform, one end of said wireform being connected to the carrier tube means, the other end of said wireform being connected to the carrier tube means, and an intermediate part of said wireform being firmly attached to a top of said charge means.

3. The perforating gun of claim 2, further comprising a detonating cord disposed between the top of said charge means and the intermediate part of said wireform, the intermediate part of said wireform holding said detonating cord firmly onto the top of said charge means thereby preventing relative movement between said detonating cord and said charge means.

4. A perforating apparatus, comprising:

a plurality of charges, each charge having a pair of pivots and being rotatable between a stored position and a deployed position;

a carrier enclosing said plurality of charges, said carrier including a plurality of openings corresponding, respectively, to said plurality of charges;

a first pullrod connected to the pivots disposed on one side of said charges;

a second pullrod connected to the pivots disposed on the other side of said charges, a force being applied to the pair of pivots of each of said charges when a corresponding force is exerted on the pullrods, and a plurality of retaining means associated, respectively, with said plurality of charges for interconnecting a top of each charge to said carrier thereby restraining movement of said top of each charge when said force is applied to the pair of pivots of each of said charges, said charges rotating between said stored position and said deployed position when said retaining means restrains movement of said top of each charge during the application of said force to the pair pivots of each of said charges.

5. The perforating apparatus of claim 4, wherein said plurality of retaining means each comprise a wireform connected to the top of each charge and to said carrier.

6. The perforating apparatus of claim 5, wherein said wireform comprises an intermediate part and two opposite ends, the intermediate part being wrapped around said top of each charge, and each opposite end being connected to said carrier.

7. The perforating apparatus of claim 5, further comprising:

a detonating cord disposed between said wireform of each charge and said top of said each charge.

8. A perforating gun for use in oil well boreholes, comprising:

charge means rotatable between a first stored position and a second deployed position for detonating and perforating a formation, said charge means having pivots;

retaining means connecting a top of said charge means to a wall of said carrier tube means for restraining movement of said charge means; and pullrod means connected to the pivots of charge means for placing a force on said pivots of said charge means in response to an accompanying force placed on said pullrod means, said charge means rotating between said first stored position and said second deployed position and said retaining means restraining movement of said charge means when said pullrod means places said force on said pivots of said charge means.

9. The perforating gun of claim 8, wherein the retaining means comprises a wireform, one end of said wireform being connected to the carrier tube means, the other end of said wireform being connected to the carrier tube means, and an intermediate part of said wireform being firmly attached to a top of said charge means.

10. The perforating gun of claim 9, further comprising a detonating cord disposed between the top of said charge means and the intermediate part of said wireform, the intermediate part of said wireform holding said detonating cord firmly onto the top of said charge means thereby preventing relative movement between said detonating cord and said charge means.

* * * * *

UNITED STATES PATENT AND TRADEMARK OFFICE

CERTIFICATE OF CORRECTION

PATENT NO. : 4,961,365

DATED : October 9, 1990

INVENTOR(S) : Rytlewski

It is certified that error appears in the above-identified patent and that said Letters Patent is hereby corrected as shown below:

COLUMN 8, Line 25;

Claim 8, line 8, delete "said carrier tube means", and insert --a carrier tube means--.

Signed and Sealed this

Thirty-first Day of March, 1992

*Attest:*

HARRY F. MANBECK, JR.

*Attesting Officer*

*Commissioner of Patents and Trademarks*